United States Patent [19]

Coch

[11] 4,062,990

[45] Dec. 13, 1977

[54] NON-POLLUTING SYSTEM FOR METAL SURFACE TREATMENTS

[75] Inventor: Lester Coch, Northport, N.Y.

[73] Assignee: Walders Kohinoor, Inc., Long Island, N.Y.

[21] Appl. No.: 694,830

[22] Filed: June 10, 1976

[51] Int. Cl.[2] ..... B05D 3/12

[52] U.S. Cl. ..... 427/242; 427/345

[58] Field of Search ..... 427/242, 345

[56] References Cited

U.S. PATENT DOCUMENTS

| | | | |
|---|---|---|---|
| 2,640,001 | 5/1953 | Clayton | 427/242 |
| 2,941,902 | 6/1960 | Talmey et al. | 427/345 |
| 3,479,209 | 11/1969 | Clayton | 427/242 |
| 3,690,935 | 7/1970 | Coch | 427/242 |
| 3,934,054 | 1/1976 | Schmeling et al. | 427/345 X |

*Primary Examiner*—Michael R. Lusignan

*Attorney, Agent, or Firm*—Burns, Doane, Swecker and Mathis

[57] ABSTRACT

This invention relates to an improved system for preventing water pollution in surface treatment of metals, e.g., in coating base metal parts with an adherent coating of zinc, cadmium or similar protective metal by means of wet impact plating or electroplating, or in chromating or phosphating metal surfaces. A preferred embodiment relates to a wet impact plating process wherein the several solutions used in cleaning or otherwise preparing the work, in plating it and in rinsing it are individually segregated after use and re-used in consecutive plating cycles in a special manner such that release of ecologically objectionable effluent is eliminated and chemical and metal components fed into the process are conserved instead of being discarded after each plating cycle. Consequently, the need for removing pollutants from process effluents can be avoided, the large volume of fresh water heretofore required to operate such a process is greatly reduced and the discard of ecologically objectionable process effluent into sewers is avoided.

Liquid effluent which is not suitable for direct recycling and re-use within the process can be rectified for further use. A considerable proportion of the water used in the process is normally lost through evaporation as the exothermic process progresses, such that the plating liquid withdrawn from the plating barrel after completion of each plating step is a relatively concentrated slurry. When this slurry can no longer be converted to chemicals useful for recycling, after precipitation and decanting of the clear liquid, water in the now very dense slurry can be evaporated from it simply by leaving the slurry containers uncovered or by using waste process heat to accelerate evaporation and the residual solids disposed of by burial or other appropriate means.

14 Claims, 6 Drawing Figures

FIG. 2
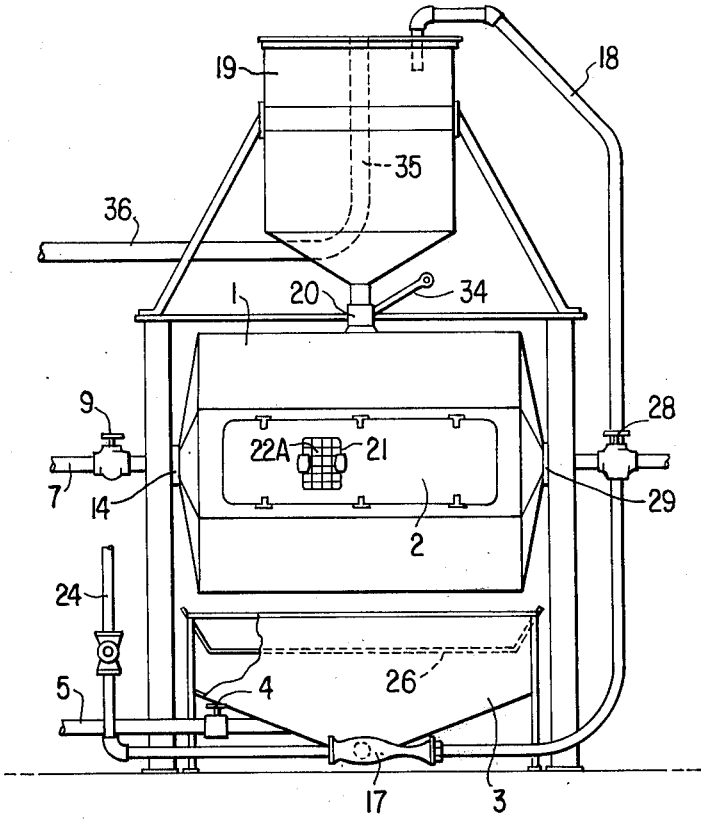
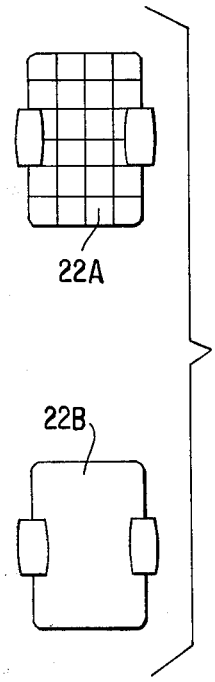
FIG. 3
FIG. 4
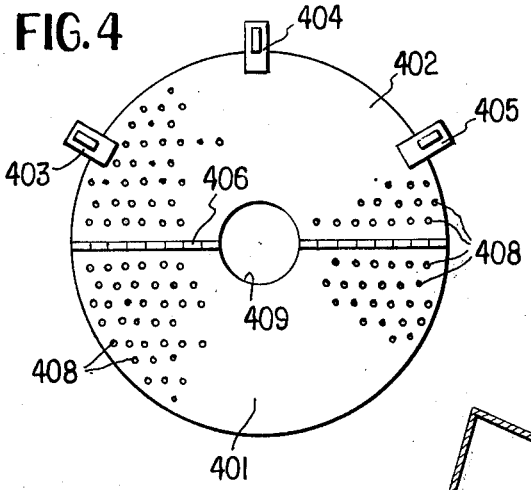
FIG. 5
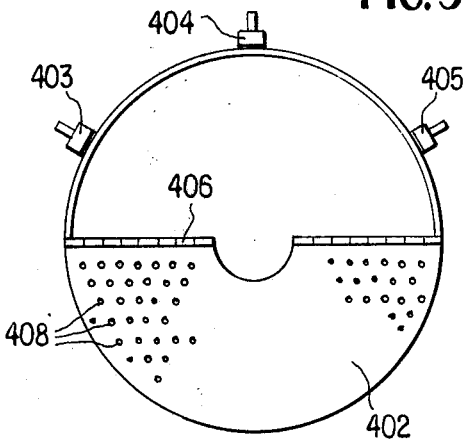
FIG. 6
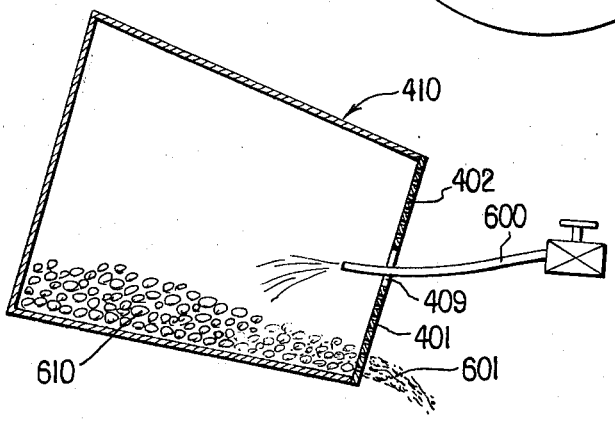

NON-POLLUTING SYSTEM FOR METAL SURFACE TREATMENTS

BACKGROUND OF THE INVENTION

SUMMARY OF THE PRIOR ART

It has been common for many years to provide a base metal such as iron with a bright, non-corroding and permanently adhered metallic coating through wet mechanical plating processes. Such processes generally involve the utilization of metal powder particles that are cold welded to the base metal by impacting against its surfaces. The parts to be plated are placed in an agitated container with the metal powder particles, with or without promoter chemicals to aid in the plating process and with or without an impacting medium such as a mass of fine glass shot, and immersed in a liquid such as water. Agitation of the mass of particulate media, metal powder and metal parts through container agitation serves to provide the impacting force necessary to the plating operation while the liquid serves both as a carrier and a lubricant.

Generally, the parts to be plated are cleansed and copper flashed prior to the actual plating operation and plated parts are separated from the particulate impacting media and the plating liquid when the desired thickness of plating metal has been plated on the parts. Processes of this sort are disclosed, for instance, in U.S. Pat. Nos. 2,689,808 to Clayton and 3,531,315 to Golben. A more recent version of a mechanical plating process is described, for instance, in applicant's prior U.S. Pat. Nos. 3,690,935 and 3,776,186.

According to the prior art, a typical process for providing base metal articles with a metallic coating comprises a batch operation wherein the base metal articles to be plated are admixed with impacting media, i.e., a matrix material consisting of a mass of fine glass beads or similar discrete solid particles, and with a suitable inhibited acidic cleaner in a container comprising suitable means for imparting mechanical energy to its contents. For instance, the container may be a closed or an open-top barrel having a shape which can induce agitation when rotated, for example, a polygonal cross-section, or a round barrel with internal struts, which can be suitably agitated, e.g., by rotation around a horizontal or, in the case of an open-top barrel, around an inclined axis.

In the case of open top-barrels, it is advantageous to use an "oblique" or truncated cone construction, i.e., a configuration wherein the container has a wider cross-section at its solid base than at its open top such that the side walls form an angle of, for instance, 80° with the base and on oblique angle with the top. When in operation, such a barrel is rotated around an inclined axis such that the plating load runs about one-half to two-thirds the way up the lower sidewall.

After several minutes of agitation and cleaning an aqueous solution of cupric sulfate and sulfuric acid is then added to this mixture. The resulting mixture is agitated until copper deposition takes place on the cleaned base metal as a pre-plate.

A solid, water-soluble promoter chemical such as a tin salt is then normally dissolved in this mixture and a quantity of plating metal in powder form, such as zinc, cadmium, brass, copper, aluminum, tin, gold, silver or the like, is added. A dispersant for the metal powder is also preferably included if a smooth plating is desired.

In this manner tin plating, for instance, is first caused to form over the copper and fine particles of the plating metal such as zinc become loosely attached to the copper-tin coated parts. The plating metal becomes impact plated or uniformly cold welded on the article by the continuing action of the impacting media and mutual impacting of the metal parts on each other when agitation of the mixture is continued for a sufficient time.

The treating liquid is finally separated from the metal-coated articles and the impacting media. This liquid which contains unused metal powder in suspension, as well as dissolved zinc and/or cadmium, copper, tin and iron, is generally discarded. The metal-coated articles which have been separated from the impacting media are rinsed clean. Rinsing is also often employed between the cleansing and copper flashing stages and sometimes between the copper flashing and the principal plating stages.

One problem associated with such previously known metal surface treating processes is the pollution which is caused by the effluent streams containing unused particles of plating metals, acid and other chemicals suspended or dissolved in the process liquids which are discarded. Another problem heretofore associated with impact plating processes has been the great volume of fresh water required to conduct the required cleanings, rinsings, etc. Yet another problem has been the loss in the discarded effluents of all the chemical and metallic components which are added in excess during the plating cycle and which are not actually expended in the process but are required to make the process function properly for reasons of container volume, geometry and lubrication of the parts to be coated, etc.

OBJECTS

The object of the present invention is to avoid or substantially alleviate the above-noted problems of the prior art. More particularly, an object of the present invention is to provide a cyclic process of the surface treatment of metal parts in aqueous media whereby the discharge of pollutant-bearing effluents is substantially reduced or eliminated.

A more specific object is to provide a cyclic process for plating base metal parts such that greatly reduced volumes of water are required for successful operation and pollution carrying effluents are minimized.

Still another object is to provide a cyclic process for wet impact plating such that a more economical use of all chemical and metal materials may be obtained.

Other objects and advantages of the invention will become apparent from the following summary and description of the present invention.

SUMMARY OF THE INVENTION

The present invention is suitable for use with either a continuous wet impact plating process, in which the cleaning step, the pre-plating step, and the principal plating step are done in sequence with no intermediate rinsing; or with an interrupted wet impact plating process in which rinsing occurs between any of the steps. The invention is similarly applicable to electroplating processes, although these are much less desirable than impact plating when freedom from mechanical failure is critical. It is well known that complete avoidance of hydrogen embrittlement is impossible to achieve in electroplating. The invention is also applicable to other metal surface treatments such as chromating and phosphating.

The continuous wet impact plating process of the prior art typically has comprised (a) admixing the metal parts or articles to be plated with a mass of impacting media and an aqueous acidic cleaner such as citric or preferably sulfuric acid (which may contain a conventional pickling inhibitor to avoid any possible risk of hydrogen embrittlement of the metal parts), the whole being placed in an agitatable container; (b) agitating the container for about 5 to 15 minutes in order to clean the articles; (c) adding an aqueous solution of a water-soluble copper salt and sulfuric or other suitable acid to adjust the pH of the aqueous liquid to between about 1 and 5 and such that copper metal plates out onto the metal articles while agitation is continued for about another 5 to 10 minutes; (d) adding the coating metal such as zinc or cadmium in powder form and conventional promoter chemicals such as a water-soluble tin salt and dispersant; (e) continuing agitation for an additional suitable period, e.g., 30 to 60 minutes, until the parts are plated; (f) opening the container at this point and draining off the liquids including iron sludge and other solid residue as a non-reusable effluent drained into the sewer while retaining the coated metal articles and the impact medium in the container (g) separating the metal articles from the particulate impact medium; (h) rinsing the articles several times with rinse water and discharging each charge of the water into a sewer or discharge basin as effluent; and (j) reloading the impact media into the container in preparation for the next load.

As is well known in the art, various urea derivatives as well as cyclic, heterocyclic and aliphatic amines, in concentrations from about 0.02% to 2%, are commonly used as adsorption type inhibitors in inorganic acid cleaning solutions. Useful inhibitors of this sort include, for instance, dibutylthiourea, cyclohexylamine, diethylene triamine, polyethanol rosinamine D and the like. Citric acid, which is sometimes used in these processes in lieu of an inorganic acid, does not usually require the use of any such inhibitor. However, it has the disadvantage of forming metal chelates which make recovery of the metal components therefrom difficult.

The essence of the present invention is the discovery that the various effluents which were discharged in the prior art as described above with reference to steps *f* and *h* need not be discarded as described but, in spite of their contamination with iron and admixture of the various chemicals from the several steps, can be recycled many times without significantly impairing plating efficiency or quality if such recycling is properly handled as more fully described hereinbelow. In the process as modified by the present invention the plating solution from step *e* above is not discarded but is rather caught in a suitable secondary container and pumped into a suitable storage tank as the plating container is emptied. This storage tank is constructed in such a manner that particular matter such as metallic particles of zinc or cadmium, which are in suspension in the effluent, may precipitate out spontaneously to the bottom of the container and clear liquid may be drawn off from a decanting spigot located a suitable distance from the floor of the container. The container is also constructed such that it has means for removal of the solid particles which precipitate and accumulate at the bottom of the container.

Rinsing of the coated metal parts is preferably done after they are separated from the impacting media as described in step *h* above, but such rinsing is also possible before any such separation. All rinse waters are again caught in a separate tank which is arranged in the same manner as the tank which contains the basic plating effluents.

In accordance with this invention, the plating effluent which has been caught and stored in the tank is used as the main aqueous fraction of the next plating cycle and although impure can, surprisingly, be reused many times with no detriment to the plating in each cycle, upon addition of fresh chemicals, coating metals and water in suitable amounts as long as the contaminant level is monitored and the liquids are rectified when the concentration of metal therein reaches a certain level. At this stage the pollutant-bearing acid effluents are rectified in the storage containers by reversing the pH to approximately 8.5 by the addition of a base such as NaOH, which will precipitate the dissolved metals as an insoluble precipitate, and then separating the precipitate from the solution. After rectification this solution is returned to a pH of 6 or less by the addition of the conventional inhibited acid solution, e.g., sulfuric acid, and may then again be used as the liquid component of the plating solution for many more cycles, until the rectification process is repeated.

Rinse waters are handled in exactly the same manner, the chief difference being that with the rinse waters the level of pollutants will always be lower by many orders of magnitude and thus the rinse waters can be reused many more times than the plating solution before rectification is required.

A considerable amount of water is normally lost in each cycle by dragout and ensuing evaporation as the coated articles are dried, as well as evaporation from the baths during the plating process itself wherein heat is generated and wherein the tumbling motion continually throws the plating solution into the warm ambient air. Because of this, the solution will continuously or periodically need additional water. Rinse water saved from an earlier cycle is, whenever available, used as makeup water for the main aqueous fraction of the plating bath. Preferably a portion of the rinse water from the first rinsing stage which is relatively impure, is taken for this purpose while the cleaner water that was previously recovered from the second rinsing stage is used as makeup water for the first rinsing step, and so on. Clear, fresh water is added as required to the water used for the last rinsing stage.

The continuous wet process was done in the prior art in two different variations. In one the impacting media were cleaned after each plating cycle, whereas in the other they are cleaned less frequently.

Another wet impact plating process to which the present invention is particularly advantageously applicable is an "interrupted" one, in which the impacting media are cleaned after each plating step. As more fully described, for instance, in U.S. Pat. No. 3,690,935 this known process has characteristically comprised (a) admixing the steel parts to be plated with impacting media and an aqueous acidic cleaner such as sulfuric acid (which again usually contains a pickling inhibitor such as dibutylthiourea) in an agitatable container; (b) pickling the parts by agitating the container for several minutes; (c) adding an aqueous solution of a water-soluble copper salt and inorganic acid, e.g., sulfuric acid, such that copper metal plates out onto the metal articles with continued agitation; (d) draining the solution from the agitatable container as a non-reusable effluent after several minutes of additional agitation; (e) thoroughly rinsing the impacting media and metal parts and draining off the rinse water as a non-reusable effluent; (f) adding the zinc or cadmium and conventional plating accelerator or promoter chemical, e.g., stannous chloride or sulfate; (g) agitating the container and contents for a suitable additional period, e.g., 30 to 90 minutes, until the parts are plated; (h) opening the container at this point and draining off the liquids as non-reusable effluent; (j) separating the parts from the impacting media; (k) rinsing the parts several times, with each batch of rinse water being allowed to flow into a discharge basin and discarded at least to a major extent; and (l) loading the media back into the container in preparation for the next load to be plated.

It should be remarked that a certain degree of water recovery and re-use is suggested in applicant's prior U.S. Pat. No. 3,690,935 and its division, U.S. Pat. No. 3,776,186. However, this previous disclosure only suggests recycling that relatively small portion of relatively pure water which is used for hydraulically lifting the impacting media from the discharge bin at the end of one cycle to the feed hopper for use in the next cycle. And in suggesting this, the prior disclosure teaches that solid matter which is recycled with such water to the storage tank is allowed to settle out and eventually removed from the tank while only relatively pure water is decanted from an upper portion of the tank to the plating barrel. The bulk of all liquid process effluent is discarded from the bin assembly 18 and clean, fresh solutions and metal powders are used in each cycle in accordance with long accepted practice. See U.S. Pat. No. 3,690,935, column 9, lines 26–33. By contrast, in the present invention all chemicals including not only dissolved acid and salts but also solid metal powder are repeatedly or indefinitely recycled and reused in the process.

In applying the present invention to the preferred interrupted impact plating process, the cleaning-coppering effluent is not discarded as described in step *d* above, but is caught in a suitable secondary container as the agitatable container is emptied and the effluent is pumped into its own suitable storage tank. This storage tank is constructed in such a manner that particulate material, such as any particles of zinc or cadmium which may be in suspension in the effluent, may precipitate spontaneously to the bottom of the tank and clear liquid may be drawn off from a decanting spigot located a suitable distance above the bottom of the tank. The tank is also constructed so that it has means for removal of the solid particles which accumulate by precipitation at the bottom of the tank.

The plating effluents as described in step *h* above and the rinsing effluents as described in steps *e* above and *k* above are each individually caught in a secondary container and each pumped into its separate storage tank of the design stated above, thus keeping each of the plating and rinsing effluents segregated from each other. Needless to say, if the same installation is sometimes used for zinc plating and at other times for plating with another metal such as cadmium, tin or brass, provision must be made for storing each such plating solution separate from the other. As the impacting media generally retain a very large proportion of plating solution adsorbed thereon after the solution is drained off and the coated parts are separated, in such a case it is advisable to have separate batches of the media for use with the zinc and with the cadmium, for instance.

The cleaning-coppering effluent which is drained from one cycle and caught and stored is recycled by being reintroduced into the agitatable container and used as the pickling solution in step *a* in a later cycle. Some new acidic cleaner or pickling solution must be periodically added to the cleaning solution to make up dragout losses and to insure proper cleaning. The invention thus reduces by many orders of magnitude the volume of fluid to be subjected to rectification procedures. By allowing virtually perpetual recycling of all process fluids, it completely avoids the necessity for conventional anti-pollution procedures because no part of such fluids ever needs to be run off into the sewer. Nevertheless, excellent plating quality is obtained.

Another known variation of the interrupted wet process involves the use of a perforate agitatable container. This embodiment has comprised (a) placing the parts to be plated in an agitatable perforate container, (b) lowering the entire container into an acid bath, (c) agitating the container, (d) removing the container from the acid bath, (e) lowering the container into a rinse and agitating, (f) removing the container from the rinse, (g) lowering the container into a bath of a water-soluble copper salt and an inorganic acid, (h) agitating the container for several minutes, (j) removing the container from the copper bath, (k) lowering the container into the rinse bath and agitating, (l) removing the metal parts from the perforate container, (m) placing the metal parts, impacting media, promoter chemical, zinc or cadmium, and water into an imperforate agitatable plating container, (n) agitating the container for a suitable period until the parts are plated, (o) opening the container and draining off the liquid as non-reusable effluent, (p) separating the parts from the media, (q) rinsing the parts several times, with the rinse water flowing into the discharge basin as effluent, and (r) reloading the media into the container for the next cycle. After several cycles, an acid cleaning step (s) is generally required for the media, the cleaning being done by placing the media in an agitatable container along with a strong acid cleaning solution and agitating the mass for a suitable period. In the prior art the acid cleaning solution was drained off as non-reusable effluent after cleaning.

In applying the present invention to this version of the interrupted process, the plating effluent drained off in step (o), the rinsing effluent drained off in step (f), and the media cleaning effluent drained off in step (s) are caught in secondary containers and pumped into suitable storage tanks, all constructed in such a manner that particulate matter such as metallic particles of zinc or cadmium which are in suspension in the effluent may precipitate out spontaneously to the bottom of the container and clear liquid may be drawn off from a decanting spigot located a suitable distance from the floor of the container. The containers are also constructed such that they have a method of removal and reuse for the accumulation of solid particles which accumulate by precipitation at the bottom of the containers.

Plating and rinsing effluents are rectified by the pH reversal method described earlier herein, returned to a pH of 6 as previously described, and then reused. The acid stripping effluents are recycled according to the method described above for recycling the cleaner-copper effluents in the preferred interrupted wet process.

Prior workers in this field have been deterred from recycling these solutions by two major factors: (1) It was generally accepted that the useful life of the chemicals had been spent in the plating process and that the chemical residues in the effluents would tend to "poison" the next cycle. (2) The variety of available commercial equipment was severely limited and the relatively small number of installations in this field offered comparatively little incentive to work towards new methods of more economical and more pollution-free plating. However, recent federal and local legislation requiring the elimination of pollutants in effluents and the radical cost increases of chemicals and metals required have radically changed the situation and given strong new incentives for major innovation in the metal surface treating industry.

THE DRAWINGS

FIG. 2 is a side elevation showing a tumbling barrel, a lower bin, an overhead hopper and piping associated therewith which may be utilized in the system of FIG. 1;

FIG. 3 shows a screen and a solid plate insert which are exchangeably used with the plating barrel when the barrel is being loaded, operated or unloaded.

Figure 1:
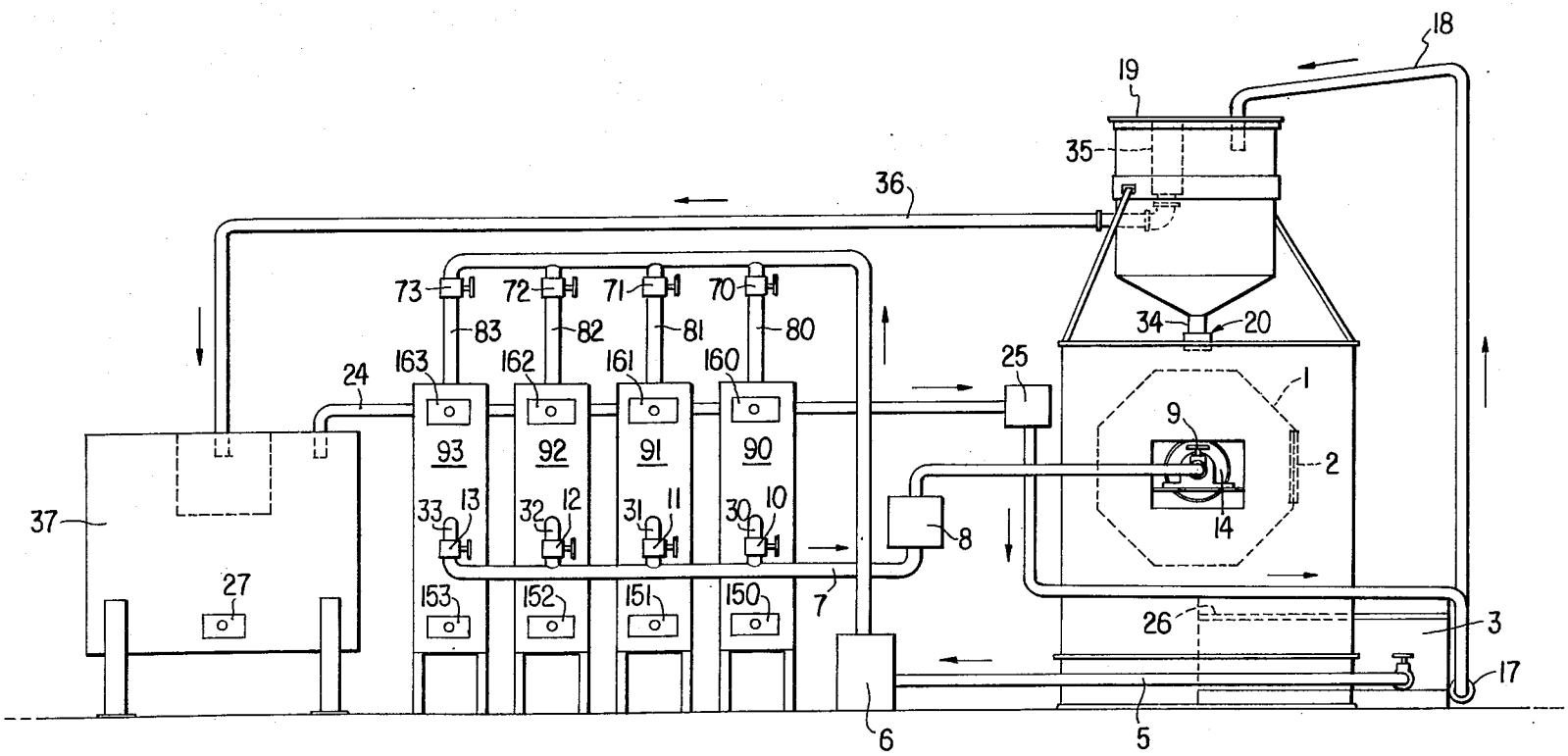
FIG. 1 is a schematic illustration of an overall system for wet impact plating of metal parts according to the present invention.

FIG. 4 is a front elevational view of the mouth of a tumbling barrel of improved design comprising a semi-circular punch half-plate 401 which is welded or otherwise fixed to the lower half of the mouth of barrel 410 (see FIG. 6), and another semi-circular punch half-plate 402 hinged by means of hinge 406 to half-plate 401 and clamped to the circumference of barrel 410 by means of clamps 403, 404 and 405. The perforations 408 of the punch plate are of such size as to let the impacting media pass through while retaining the parts being processed. A hole 409 is provided in the center of compound plate 401/402 to permit insertion of a water hose or pipe 600 therethrough.

FIG. 5 is a front elevational view of the mouth of the same tumbling barrel as that shown in FIG. 4, but with the upper half-plate 402 folded down over half-plate 401, for ease of loading metal parts and plating chemicals into the barrel. When the barrel is in operation and revolving around an inclined axis with its open mouth facing upward, the half-plate 402 may be either in the position shown in FIG. 5 or in that shown in FIG. 4.

FIG. 6 shows a barrel 410 in transverse cross-section with its mouth facing downward in its seiving and dumping position, with half-plate 402 firmly clamped in position, and hose 600 spraying rinse water into barrel 410 through hole 409. As barrel 410 is rotated, the relatively large-size plated parts 610 are retained in the barrel while being rinsed and the relatively small-size media are bled out of the barrel through perforations 408 in the stream of rinse water 601. Separation of parts from media and rinsing can thus be accomplished with a minimum of rinse water and the need for a separate screening of parts from media outside the barrel is totally avoided.

DETAILED DESCRIPTION

Typical Apparatus of the Invention

One preferred embodiment of the invention will now be described with reference to FIG. 1.

This apparatus includes a conventional agitatable plating barrel 1, a secondary container or bin assembly 3 for catching all effluents from the door or opening 2 of the plating barrel 1, a manifold 5 with a selective cut-off valve 4 for conducting the effluents from bin 3 to a series of effluent storage tanks 90, 91, 92 and 93 and a pump 6 in manifold 5 to provide a means of flow, and connector conduits 80, 81, 82 and 83, each equipped with a separate cut-off valve 70, 71, 72 and 73 individually connecting each of the storage tanks to manifold 5. Each storage tank 90–93 is equipped with a removable precipitate door 150–153 and a removable chemical addition door 160–163. A return manifold 7 is connected to each effluent tank 90–93 by its own connector conduit 30–33 with selective cut-off valves 10–13 located between each effluent tank 90–93 and its connector conduits 39–33. A pump 8 is located in return manifold 7 to provide a means of flow. A cut-off valve 9 is located between the return manifold 7 and the agitatable plating barrel 1. A rotatable entrance valve 14 serves as an inlet for returning liquids from tanks 90–93 to barrel 1 via manifold 7. The removable plate door 2 of barrel 1, when removed, permits loading and unloading of media and parts to be plated. When closed, door 2 permits rotation of the barrel 1 without spillage of its contents.

Referring to FIG. 2, which is analogous to FIG. 2 of U.S. Pat. No. 3,690,935, the removable door plate 2 of barrel 1 further also contains a porthole 21 which can be covered either with a removable screen 22A or with a solid cover 22B of the same size. With screen 22A in place, the liquid can be drained from barrel 1 at the end of a cleaning or plating step while retaining the media and/or parts to be plated or plated parts in barrel. While a cleaning or plating step is in progress, the perforate insert 22A is replaced or covered by a solid insert 22B. A perforate screen 26 for separating media and parts is provided at the top of bin 3, a venturi eductor 17 is provided in conduit 18 for hydraulically lifting the separated media via conduit 18 from bin 3 into media storage hopper 19. Media flow orifice 20 and media cut-off valve 34 serve as a means for returning the media from hopper 19 to the plating barrel 1. Screened water overflow inlet 35 and overflow water conduit 36 serve to carry excess water to water storage tank 37 from hopper 19. Water return conduit 24 and water return conduit pump 25 serve to provide water from tank 37 to eductor 17. Rotatable valve 29 equipped with a water cut-off valve 28 provides a means for adding fresh water to barrel 1 from an external fresh water source.

Clean-out door 27 in media transfer water tank 37 permits periodical removal of sediment from this tank. As disclosed in the prior art, tank 37 serves to hold the water that is used for hydraulically transferring the media from bin 3 via eductor 17 and conduit 18 to the media storage tank 19 betweem cycles. The water returns to tank 37 via the screened orifice 35 and conduit 36. The clean-out door 27 is needed because the media always contain residues of cadmium and/or zinc, copper, tin and iron both as particulate matter and in solution as carryover from the plating cycles, and these residues continually settle out to some extent in tank 37 and from time to time are subject to rectification or forced precipitation while in tank 37. Alkalis or other chemicals used for such rectification can be added through its open top as needed.

Operation of the System

EXAMPLE 1

In practicing the present invention, for instance, for continuous wet impact plating, the initial cycle is run conventionally according to the procedure as taught by the prior art using the equipment shown in FIGS. 1 and 2. More particularly, a bath of impacting media such as glass beads is placed in bin 3. Water is drawn from water tank 37 via conduit 24 and with line force provided by pump 25 is passed through eductor 17. The media resting in bin 3 will be drawn up with the water through conduit 18 into media hopper 19. The plate door 2 of the plating barrel 1 is removed from its frame and horizontally disposed barrel 1 is rotated into position such that the resulting door opening 2 rests under aperture 20 of hopper 19. Cut-off valve 34 is then opened and the batch media falls into the plating barrel 1. Barrel 1 is then rotated to position door opening 2 conveniently for loading the metal parts to be plated and conventional concentrated inhibited acidic cleaner solution into barrel 1, and the opening 2 is closed by placing the solid door plate back in position. Cut-off valve 28 is opened and clear water is taken in through the rotatable entrance valve 29 until barrel 1 is partially filled with aqueous liquid to a suitable level to provide proper lubrication, tumbling and cleaning action on the metal parts to be treated. For instance, between about 10 and 60% of the barrel volume may be filled with liquid in this step as well as in the later steps. Cut-off valve 28 is then closed. The barrel 1 is then rotated for several minutes, with solid door plate 2 including imperforate porthole cover 22B in place. Cover 22B is then removed, the aqueous solution of cupric sulfate and sulfuric acid is added, cover 22B is replaced and the plating barrel 1 is rotated again for several minutes. Cover 22B is then removed and the zinc or cadmium or other metal particles and stannous chloride or other appropriate promoter chemicals are added and the pH of the solution is about 2.5 to 3.5. Cover 22B is replaced and the agitatable container plating barrel 1 is rotated for a suitable period until the parts are plated, all in a manner heretofore conventional in the art.

According to the present invention, the screen or perforate plate 22A is mounted on porthole 21 of door 2 in lieu of the solid cover 22B and barrel 1 is rotated until plate 22A faces downward such that the liquid is emptied from barrel 1 through perforate plate 22A into bin 3. The perforations of screen 22A are of a size fine enough to retain the impacting media and metal parts to be coated but coarse enough to permit finer particles to pass through along with the liquid. Cut-off valve 4 is then opened and the plating effluents collected in bin 3 is transported to storage tank 90 via manifold 5 using line force from pump 6. Cut-off valve 70 on tank 90 is opened while cut-off valves 71, 72 and 73 on tanks 91, 92 and 93 are closed. The effluent moves through manifold 5 and conduit 80 into tank 90. When bin 3 and manifold 5 are substantially clear of the effluent, cut-off valve 4 and cut-off valve 70 of tank 90 are closed.

At this stage, for the first cycle only, cut-off valve 28 is opened and a suitable quantity of fresh rinse water is fed into barrel 1 via rotating valve 29. Imperforate plate 22B is placed in position over porthole 21 and the plating barrel 1 is rotated for several minutes. Perforate plate 22A is then placed in position over porthole 21 and the plating barrel 1 is then rotated into position such that the rinse water is drained into bin 3. Cut-off valve 4 on manifold 5 and cut-off valve 71 on conduit 81 are then opened and the rinse water is thus pumped from bin 3 via manifold 5 to tank 91. When bin 3 is substantially clear of effluent, cut-off valves 71 and 4 are closed.

The number of rinses given to plated metal parts after plating is a function of the quality requirements of the particular plated parts and vary widely. In the illustrated embodiment, tanks 91, 92 and 93 have been provided for rinsing effluents, giving a capability of three consecutive rinses. In many cases, one rinse will suffice in which case only tank 91 would be required and tanks 92 and 93 as well as supporting inlet valves 72 and 73, inlet conduits 82 and 83, outlet valves 12 and 13, and outlet conduits 32 and 33 may be omitted or left unused. If a greater rinse capability is required for a given plated product, a correspondingly greater number of storage tanks and connector conduits, etc., is provided.

Consecutive rinses of the initial cycle proceed according to the description given above for the first rinse, until the desired number of rinses is completed. The rinse water from each rinse is stored on its own separate storage tank.

When rinsing has been completed, removable door 2 is removed and the plating barrel 1 is rotated so that the drained media and the plated parts fall on separating screen 26 on which the plated parts are retained while the impact media pass through the screen into bin 3. The media are then hydraulically lifted back to media storage tank 19 as already described earlier herein and as well as in U.S. Pat. 3,690,935 and 3,776,186.

To commence the next cycle of plating according to the present invention, the media and next batch of parts to be plated are loaded into barrel 1 after removal of door 2 in the same manner as described earlier herein, as is the inhibited acid cleaner. Next, however, instead of adding fresh water to bring the liquid in barrel 1 to the level appropriate for effective operation, previously used plating effluent is pumped back to barrel 1 from tank 90 via lines 30 and 7. When tank 90 is empty, or when enough liquid has been charged to barrel 1, cut-off valve 10 is closed. If there is insufficient liquid in barrel 1, cut-off valve 11 is opened and the required additional liquid is pumped into barrel 1 from tank 91 via lines 31 and 7 through rotatable valve 14. When there is sufficient liquid to commence the cycle, cut-off valve 9 is closed, removable door plate 2 is replaced on barrel 1 with inperforate porthole cover 22B in place and the cleaning and plating operation is repeated as before except that dosages of fresh acid cleaner, other soluble chemical and plating metal powder may be reduced allowing for the excess amounts carried into tank 90 in the effluent from the previous cycle.

The quantity of each of these excess chemicals and metals carried over from the previous cycle can be readily determined by routine analysis. If desired, however, such carryover may be disregarded and the same quantities of each of the several chemicals used in consecutive cycles until plating efficiency (as defined hereinbelow on page 38 notes 2 and 3) drops below 100%, e.g., to 95 or 90%, or until some other preselected performance characteristic, such as minimum acceptable degree of product brightness or color is reached. When that point is reached, the process liquids are rectified by precipitation of their metal content and the rectified liquids are then reused. With proper chemical separation, the precipitated metal compounds may also be reused after conversion to the appropriate soluble salt such as stannous sulfate or elemental metal such as zinc.

As is well known in the art, the amounts of cleaning acid, cupric sulfate and sulfuric acid, promoter chemical and zinc or cadmium which are added to achieve plating are functions of the surface area of the product to be plated, the bulk density of the product, the total mass of the load of parts to be plated, the volume of the agitatable plating barrel 1 and the thickness of the plating desired. The efficiency of wet impact plating in fully using the chemicals and plating metals charged to the process varies widely with the energy level used, the bulk density of the parts to be plated, the aesthetic and physical quality of plating desired and the relationship of the volume to be plated to the volume of the plating barrel. In general, the greater the bulk density of the parts to be plated, the more efficient the plating will be in using the chemical and metal particle additions. Accordingly, depending on the specific product quality desired and the process conditions selected to achieve it, the useful residual fractions of chemical and metal particles will vary widely.

After completion of the coppering step the plating cycle is as previously described except that reduced dosages of chemicals and metal particles may be used as discussed above, allowing for the residual amounts of such components which remain available in the recycled process liquids. At the conclusion of the second plating cycle, the effluent is removed from barrel 1 by the identical process as described earlier herein at the end of the first cycle and stored in tank 90 for use in the next cycle.

The first rinse of all cycles except the first cycle is accomplished as follows: Cut-off valve 11 and cut-off valve 9 are opened and the used rinse water stored in tank 91 is pumped into barrel 1 via conduits 31 and 7 are rotatable valve 14 with line force provided by pump 8. When tank 91 is empty, cut-off valve 11 is closed. If this does not provide the desired volume of rinse water in barrel 1, and if a second rinse has been used on the first cycle and stored in tank 92, cut-off valve 12 is opened and a sufficient additional volume of used rinse water from tank 92 is added into barrel 1 to complete the volume required for the first rinse via conduits 32 and 11 and rotatable valve 14.

If no such used rinse water is available from an earlier cycle, fresh water from an external source is fed in an appropriate volume into barrel 1 via valve 28 while valve 11 remains closed. Visual observation of the contents of barrel 1 during the water charging operation may be made upon removal of imperforate door insert 22B.

A substantial quantity of water is usually lost in every plating cycle. This is primarily due to two factors:

a. the evaporation of water by the heat generated by the mechanical and chemical energy spent during the impact plating process and b. the evaporation of water which is carried out on the metal parts after plating and evaporated when the parts are dried. This evaporation is a function of the energy level used in plating and the surface area of the parts being plated. The evaporation of water in the process naturally is greater when the plating barrel is of the open-top type revolving on an inclined axis than when it is a closed barrel revolving on a horizontal axes as shown in FIG. 1.

According to the present invention, the liquids required to make up this loss in the plating effluent stored in tank 90 are preferably made up with liquid from the first rinse stored in tank 91 or with fresh water from an external water source. The first rinse loss both from evaporation and from liquid used to replenish the plating effluent is made up from the second rinse, or with fresh water when necessary, etc. In any event, the make-up liquid required for the last rinse is clear, fresh water taken in from an external source through rotatable valve 29.

According to the present invention, plating of metal parts in consecutive cycles and recycling of process liquids from one cycle to a later one continues indefinitely as described until the plating effluent level reaches the following contaminant levels:

| Metal | Total Contaminant Content, In Suspension and Solution PPM |
|---|---|
| Zinc or cadmium | 130,000 - 180,000 |
| Copper | Inconsequential |
| Tin | Inconsequential |
| Iron | 12,000 - 18,000 |

Generally speaking, the lower contaminant levels are preferred when a very bright plating is desired but a good quality plating can be obtained at or even above the upper limits stated if a high degree of brightness is not required. Copper and tin residues usually are no problem because the copper and tin salts are added to the process in relatively small amounts in the first place and are as a rule substantially completely consumed in each cycle, Thus, the concentrations of copper and tin in the plating effluent at the end of each cycle normally remain between about 30 and 50 ppm in the case of copper and less than 3 ppm in the case of tin, which concentrations are inconsequential as far as the next cycle is concerned.

When the contaminant levels indicated above are reached, the solution is rectified. This is accomplished as follows. After the plating effluent has been transferred to tank 90, removable port 160 is removed and NaOH is added in an amount sufficient to precipitate the metal salts dissolved in the liquid present (to pH 8–8.5) and port 160 is replaced. The amount of NaOH required for this purpose can be readily determined in an empirical manner on aliquot samples of liquid removed from the tank. After a suitable period, normally several hours, the treated liquid in tank 90 is decanted and transferred to the agitatable barrel 1 by opening cut-off valves 10 and 9 and pumping the liquid via conduits 30 and 7 and rotatable valve 14. After cut-off valves 10 and 9 are closed, the next plating cycle may begin again.

While tank 90 is empty of liquid, removable port 150 is removed near the bottom and the precipitated sludge comprising mainly metal hydroxides and some metallic particles is removed. Removable port 150 is then replaced, and plating process continues as previously described. The sludge can be further processed to separate re-usable metal particles therefrom to reconstitute the desired metal salts such as copper sulfate and tin chloride from the sludge, or the sludge can be buried in an appropriate dump.

The process of rectification of rinse waters and media transfer waters is identical to that given for the plating effluent above. The limits for pollutant levels for rinse waters and media transfer waters are as follows:

| Metal | Total Contaminant Content, In Suspension and Solution PPM |
|---|---|
| Zinc or cadmium | 5,000 - 9,000 |
| Copper | Inconsequential |
| Tin | Inconsequential |
| Iron | 1,000 - 2,000 |

The rectification of rinse waters is required far less frequent than for the plating effluent, since most of the pollutants are carried out in the plating effluents. In addition, a large amount of pollutants both in suspension and in solution, is removed from the process in the liquid which remains occluded in the media when these are dumped from the plating barrel into bin 3. These pollutants are cleaned off the media by the turbulent action of the water used for lifting the media from bin 3 to hopper 19 as described in U.S. Pat. No. 3,690,935 and also earlier herein.

EXAMPLE 2

A particularly preferred embodiment of the present invention relates to the interrupted wet impact plating process, which is more fully described below.

According to this embodiment, the initial cycle is run according to the prior art procedure described in the first part of Example 1 above. However, unlike in the prior art, all effluents are again caught and stored for reuse. More particularly, using a barrel having a capacity of 1 cu.ft. (28.3 liters), an appropriate load of steel stampings to be plated (about 455 grams) is first cleaned by being tumbled in barrel 1 in the presence of the impact media (glass beads weighing about 500 grams) for several minutes in 250 cc. of conventional inhibited acidic cleaning solution containing about 14.5 cc. $H_2SO_4$. The steel stampings occupied a volume of 230 cc. and had a surface area of 0.267 $m^2$ (2.87 sq.ft.). After being cleaned the stampings were coppered by being tumbled for several more minutes after addition of an aqueous solution containing a small amount of cupric sulfate (0.6 grams) and sulfuric acid, all as is otherwise well known and more fully described in Example 1 above. According to this embodiment of the invention, however, before proceeding with the plating process containing the inhibited acid cleaner, any residual copper sulfate and sulfuric acid is drained at the end of the coppering step from the parts and media in barrel 1 into bin 3 after replacing solid door insert 22B with the perforate door insert 22A. Valve 4 on bin 3 and valve 70 on tank 90 are then opened and the trapped effluent containing sulfuric acid and traces of unused cupric sulfate is pumped from bin 3 via manifold 5 into tank 90 while valves 71, 72 and 73 remain closed. When the bin 3 and manifold 5 are substantially clear of the effluent, valves 4 and 70 are closed.

Next a small amount of buffering chemical, for example sodium citrate ($C_6H_5O_7Na_3.2H_2O$), is added to barrel 1 in order to keep the pH of the solution in the next step between about 2.5 and 3.5. Also added at this stage are conventional plating promoter chemicals including 1.4 gram of stannous chloride, and small amounts of citric acid and dispersants. Valve 28 is opened and clear water is taken in through rotatable entrance valve 29 until barrel 1 is partially filled so as to submerge the parts and impact media in the water. Cut-off valve 28 is then closed. Imperforate door 22B is then replaced and barrel 1 is rotated for about five minutes until a thin tin coat is deposited over the copper coat. 14.4 grams of zinc dust, i.e., the metal to be plated on the base metal parts, is charged into barrel 1 after temporary removal of imperforate door plate 22B. After replacement of plate 22B the barrel 1 is rotated for a suitable period of several minutes during which interval the parts are plated. Imperforate plate 22B is then removed and replaced with perforate plate 22A. Barrel 1 is rotated so that the plating liquid is drained off through perforate plate 22A into bin 3. Valve 4 is then opened and the collected effluent is pumped from bin 3 via conduits 5 and 82 to tank 92 while valve 72 on tank 92 is opened and valves 70, 71 and 73 on the other storage tanks are closed. When bin 3 and conduit 5 are clear of the effluent, valves 4 and 72 are closed.

Perforate door insert 22A is then replaced with imperforate insert 22B, valve 28 is opened and clear water is charged into barrel 1 via rotatable entrance valve 29. Valve 28 is then closed and barrel 1 rotated for several minutes to rinse the plated parts. Imperforate door insert 22B is then removed and replaced with screen insert 22A and barrel 1 is rotated so that the rinse water is drained from the barrel through screen 22A into bin 3. From bin 3 the collected rinsing effluent is pumped via conduits 5 and 83 into tank 93 while valve 73 on tank 93 is opened and valves 70, 71 and 72 on the other tanks are closed. When bin 3 and conduit 5 are clear of the effluent, cut-off valves 4 and 73 are closed.

Of course, the number of rinses given to plated metal parts after plating is a function of the quality requirements of the particular plated parts and vary widely. In the presently described embodiment only one of the storage tanks, tank 93, is used for storing rinsing effluent. In many cases one rinse is sufficient. If a greater number of consecutive rinses is required for a given part, a corresponding number of additional storage tanks is provided in the system.

After removal of the rinse water from bin 3, the removable door 2 is removed from barrel 1 and the barrel is rotated so that the drained glass beads and steel stampings fall through the door opening, with the plated parts being retained on screen 26 while the glass beads pass through the screen into bin 3.

According to the present invention, to commence the next cycle of plating, the loading of media and parts into tumbling barrel 1 again proceeds according to the details previously given. With removable door 2 removed, cut-off valves 9 and 10 are opened, and the inhibited acid cleaner effluent containing traces of cupric sulfate is transferred from tank 90 to barrel 1 via conduits 30 and 7 through rotatable valve 14. When tank 90 is empty or when enough liquid has been charged into barrel 1, cut-off valve 10 is closed. A fresh batch of inhibited acid cleaner is added through the opening left by the removal of door 2 to insure adequate cleaning of the next batch of steel parts to be plated. If the liquid available from tank 90 is insufficient for proper operation of the cleaning step, cut-off valve 28 is opened and a suitable quantity of fresh water is added to barrel 1 from an external water supply via rotating valve 29. Cut-off valve 28 is then closed, removable door 2 is placed on the agitatable container plating barrel with imperforate door plate 22B in place and the cleaning step commences as before and the entire process is repeated substantially as described above, re-using in each step the liquid preserved from the corresponding step of the preceding cycle with the addition of appropriate fresh chemicals and plating metal.

For the sake of simplicity, the same amount of fresh chemicals and metal was added to the process in each cycle as if virgin liquid were used, although in commercial operation it may be preferable to reduce the amounts of the chemicals added in later cycles by allowing for the amounts of the same chemicals which are returned to the respective steps in the liquids which are recycled. An important advantage of the present invention is that it makes it practical and economical to use the various chemicals such as the tin and copper salts and the plating metals in the several steps in substantial oversupply in excess of the amounts intended to be actually consumed therein, and thereby provide a strong "driving force" allowing the formation of proper metal deposits in an efficient manner. Yet, despite such excess amounts used, they are not lost in the process effluents and pollution otherwise caused thereby is avoided due to the special recycling scheme employed.

for use in the zinc plating step of the next run or cycle was determined by wet analysis of aliquot samples.

The results are shown in Table I below.

The method for determining zinc in brass and bronze electroplating solution, described in Metal Finishing Guidebook 1976, published by Metals and Plastics Publishing Inc. (1976), Handbook of American Electroplating Society, page 342, was the wet analysis method used in determining the zinc content of the process liquid in this example. When cadmium is the plating metal used, the method described on page 344 of the same Guidebook can be used to determine the cadmium content of the process liquid. Atomic absorption analysis was also used as a cross-check for determining the metal content of the process liquids. Suitable methods of this kind are described, for instance, in E.P.A. Manual 625-/6-74-003, "Methods for Chemical Analysis for Water and Wastes."

TABLE I

| | 1st Sequence | | 2nd Sequence | | 3rd Sequence* | |
|---|---|---|---|---|---|---|
| Run | Zn, PPM[1)] | Plating Efficiency[2)] | Zn, PPM | Plating Efficiency | Zn, PPM | Plating Efficiency |
| All new | 0 | 100% | | | | |
| 1 After Rectification | n.a. | n.a. | Not Determined | | 21,610 | 100% |
| 2 | 33,750 | 102% | 36,300 | 109% | 32,800 | — |
| 3 | 52,500 | 162% | 57,000 | 118% | 43,130 | 129% |
| 4 | 71,250 | 189% | 75,750 | 136% | 63,380 | 117% |
| 5 | 82,500 | 149% | 90,000 | 109% | 63,380 | 100% |
| 6 | 105,000 | 98% | 101,250 | 95% | 60,100 | 100% |
| | (Rectification) | | (Rectification) | | (Rectification) | |

*Sequences 4 through 15 gave results closely resembling those in the 3rd sequence, indicating that by the end of the 3rd sequence a condition of approximate equilibrium was reached.

[1)]Before plating and before addition of fresh chemicals.

[2)]Plating efficiency $= \frac{\mu \text{ measured}^{3)}}{\mu \text{ targeted}}$

[3)]$\mu$ = thickness of deposited zinc plate (by Magnagage), error $\approx \pm 5\%$ Thus, a fresh amount of aqueous solution of cupric sulfate and sulfuric acid is added to barrel 1 before proceeding with the next coppering step and fresh amounts of promoter chemicals, such as stannous chloride and dispersant and plating metal powder are added to the liquid withdrawn from tank 92 to barrel 1 before proceeding with the next tinning and plating steps, respectively. In each case the process liquids or rinse waters used in the process are again pumped from barrel 1 into the appropriate storage tank upon completion of each step for further similar use in the next cycle. If the liquid preserved from a given step in one cycle is insufficient for the corresponding step of the next cycle, the deficiency may be made up by using previously used rinse water stored in tank 93 or tank 37 or fresh water from an external source via valve 29.

The entire process was thus repeated for 90 runs or cycles in succession, with rectification of the plating effluent (stored in tank 92) after each series of six consecutive runs. Rectification was carried out by precipitation with NaOH at pH 8 to 8.5 as described earlier herein.

To further illustrate the operation and effectiveness of the interrupted impact plating process just described, the plating efficiency (actual plating thickness; targeted plating thickness) and the zinc content (both in solution and solid dispersion) of the liquid withdrawn from tank 92 upon completion of one run and recycled to barrel 1

As Table I shows, plating efficiency goes up very significantly in the first three or four runs of each series and then starts to decrease, but even in the sixth run of each series the plating efficiency is substantially as good as in the first run. As long as the process is operated within the proper limits high plating efficiency is maintained throughout due to the overdosing which is made economically possible in this invention because of the high degree of metal recovery after each run. High plating efficiency maintenance is of particular importance when coating thickness is critical.

When rectified by addition of sodium hydroxide and precipitation and separation of the precipitated sludge by decanting off the clear liquid, the zinc content of the remaining plating liquid can be readily reduced to less than 30,000 ppm, e.g., to between about 15,000 and 20,000 ppm and thereby made fit for further continued use. More particularly, at the end of the eighteenth cycle, i.e., at the end of the sixth run of the third sequence, the effluent after rectification was approximately 20,000 ppm and may be used for further plating. Of particular interest is the apparent stability of runs 4, 5 and 6 of the third sequence, indicating that an equilibrium of Zn, Fe, Cu and Sn was reached in the effluent.

The process does not need close continuous control and analysis, but merely a periodic monitoring of the plating efficiency obtained. Only when the observed plating efficiency drops back to or slightly below 100% does it become necessary to rectify the process effluent before further use.

Frequency of rectification can be further reduced by sizing the storage tanks, such as tank 92, such that they will hold a multiple (e.g., triple, quintuple or 10 times) of the volume of liquid used in an individual run. Thus, for instance, by sizing storage tank 92 to hold five times the volume of liquid used in an individual run, rectification may only be required after each twenty-fifth or thirtieth plating run, allowing not less than 70 or 80 uses of the liquid. In determining the optimum storage tank volume for any given installation, the cost of rectification must be weighed against, among other factors, the cost of the higher inventory of chemicals required in a process wherein a large volume of plating liquid is accumulated in storage tanks.

Thus, it can be seen that, with proper rectification and proper sizing of storage tanks, a given volume of liquid can be re-used indefinitely without sacrificing plating efficiency. At the same time, a very high degree of conservation of plating metal can be achieved. As the cost of the plating metal, such as zinc or cadmium, is a very substantial fraction of the total cost of the plating operation, the present invention makes possible major savings, as well as avoidance of pollution. The invention is of particularly great value when a sequestering agent, such as citric acid or sodium citrate or an aminocarboxylic acid or salt thereof, is used in the plating process. Because such sequestering agents form complexes with heavy metals which are difficult to recover out of solutions, the recycling thereof which this invention makes possible is important both because of the attendant conservation of the metal and because of the elimination of pollution that would otherwise be caused thereby.

The invention has been found to be of particular value in plating parts of low bulk density, e.g., steel parts having a bulk density in the range between about 5 and 15 lbs./cu.ft. (between 80 and 240 kg/m$^3$). Wet impact plating of such low density parts has been heretofore considered totally impossible or impractical, it being well recognized in the art that impact plating can be economically carried out only with plating loads having a bulk density of at least about 30 lbs/cu.ft. (480 kg/m$^3$). Because the present invention makes it ecologically and economically possible to use in the load a large excess of plating metal, e.g., 30%, 50% or even 75% excess over the amount theoretically required to deposit a predetermined thickness (e.g., at least 0.001 inch or 0.025 mm) of metal on the substrate to be plated, this permits raising the load density to the range suitable for effective plating without undue loss of platng metal and without pollution of the environment. In such a case, for instance, the concentration of plating metal powder in the plating mixture is increased to about 2.5 g/liter, e.g., between 2.6 and 3.6 g/liter.

The foregoing specification provides a description of the nature of the invention and gives specific examples of desirable modes in which it can be carried out. However, it should be understood that this has been done for purposes of illustration rather than limitation, and that the disclosed invention can be practiced in other variations and modifications without departing from its spirit or legal scope which is particularly pointed out in the appended claims.

What is claimed is:

1. A cyclic process for the mechanical impact plating of consecutive batches of base metal articles without discharge of ecologically objectionable liquid effluent from the process, which process comprises a multiplicity of sequences of several cycles each, with withdrawal of different used treating liquids and suspended excess metal powder from each cycle and re-use thereof in a later cycle and with rectification of treating liquid between sequences, and A. wherein each cycle comprises the steps of a. loading a batch of base metal articles having a known total surface area into a tumbling zone;

b. loading a mass of impacting media and an aqueous inorganic cleaning acid solution into said tumbling zone and agitating the resulting mixture in said tumbling zone until the articles are cleaned;

c. adding a water-soluble copper salt to the mixture of cleaned articles, impacting media and acid solution and agitating the resulting mixture of the tumbling zone until copper metal plates out onto the metal articles;

d. next adding to the mixture in the tumbling zone a water-soluble salt of tin and agitating the resulting mixture of solids and liquid in the tumbling zone;

e. adding a malleable metal powder selected from the group consisting of zinc, cadmium, brass, copper, aluminum, tin, lead, gold and silver to the mixture in the tumbling zone in an amount which is at least 1 to 75% in excess over the amount of metal required to deposit a predetermined thickness of said malleable metal uniformly over said metal articles and agitating the resulting mixture of solids and plating liquid in the tumbling zone at a pH between about 1.5 and about 4 for a time empirically predetermined to provide a malleable metal plating of predetermined thickness on said metal articles while the plating liquid becomes depleted;

f. removing the depleted plating liquid including metal powder suspended therein from the tumbling zone and passing it to a plating liquid storage zone;

g. adding rinse water to the plated metal articles and impacting media in the tumbling zone and agitating the mixture to effect rinsing of the plated metal articles;

h. removing the used rinse water from the tumbling zone and passing it to a rinse water storage zone;

i. removing the plated metal articles and the impacting media from the tumbling zone and separating the articles from the media;

j. storing the separated media in a media storage zone; and k. recovering the plated metal articles; and B. wherein the next cycle comprising steps (a) through (k) is begun with a new batch of base metal articles while returning to the tumbling zone in step (a) the depleted plating liquid including suspended metal powder from the plating liquid storage zone and the separated impacting media from the media storage zone, adding a make-up amount of cleaning acid thereto insure proper acidity for cleaning the metal articles; and while returning to the tumbling zone in step (g) previously used rinse water from the rinse water storage zone; and C. wherein additional cycles comprising steps (a) through (k) are carried out as in (B) until process performance in step (e) reaches a predetermined level, at which stage the plating liquid is rectified by adding alkali thereto to precipitate metal compounds from the liquid, mechanically separating the precipitated compounds from the liquid, and further using the liquid in the process after acidifying it.

2. A process according to claim 1 wherein substantially all of the copper added as a copper salt in one cycle of the process is plated out as metallic copper on the articles in the same cycle and only an inconsequential amount of copper remains in solution at the end of step (c).

3. A process according to claim 1 wherein the malleable metal powder is zinc, said metal powder is present in step (e) in an amount which is at least 30% in excess of the amount required to deposit the predetermined thickness of said metal over the acticles in said step (e) and wherein substantially all of the tin added as a tin salt in one cycle of the process is plated out as metallic tin on the articles in the same cycle and only an inconsequential amount of tin remains in solution at the end of step (e).

4. A process according to claim 3 wherein the metal articles are ferrous articles and wherein steps (a) through (k) are repeated through a plurality of cycles until process efficiency in step (e) reaches a predetermined minimum level, at which stage the plating liquid is rectified by adding alkali thereto to raise the pH thereof to between about 8 and 8.5 and thereby precipitate the dissolved metal content therefrom, and mechanically separating the resulting precipitate from the liquid before further use of the liquid in the process.

5. A process according to claim 1 wherein steps (a) through (k) are repeated through a plurality of cycles until plating efficiency in step (e) determined in terms of the thickness of the plating on the recovered plated metal articles is reduced to below 100% and not less than 95%, at which stage the plating liquid is rectified by chemically precipitating the metal content therefrom before further use in the process.

6. A process according to claim 1 wherein a portion of the previously used rinse water is fed in step (e) of one cycle from the rinse water storage zone to the tumbling zone to compensate for the volume of plating liquid lost in a previous cycle.

7. A process according to claim 3 wherein extraneous water is fed to the tumbling zone in step (g) to make-up any deficiency in rinse water volume.

8. A cyclic mechanical impact plating process for plating consecutive batches of base metal articles without liquid discharge of econologically objectionable liquid effluent from the process and with reclaiming of substantially all treating water withdrawn from various stages of the process wherein A. each process cycle comprises the steps of a. loading a batch of base metal articles having a known total surface area into a tumbling zone;

b. loading a mass of impacting media and an aqueous inorganic cleaning acid solution into said tumbling zone and agitating the resulting mixture in said tumbling zone until the articles are cleaned;

c. draining the spent acid solution from the tumbling zone and passing it to a spent acid storage zone;

d. adding an aqueous solution of a water-soluble copper salt to the cleaned articles and impacting media and agitating the resulting mixture in the tumbling zone until copper metal plates out onto the metal articles;

e. draining the spent aqueous copper solution from the tumbling zone and passing it to a spent copper solution storage zone;

f. adding water, promoter chemicals containing a soluble tin salt, acid and a buffer for keeping the resulting aqueous mixture in the tumbling zone at pH between about 2.5 and 4 and agitating the metal articles, media and aqueous mixture;

g. adding a malleable metal powder selected from the group consisting of zinc, cadmium, brass, copper, aluminum, tin, lead, gold and silver to the mixture in the tumbling zone in an amount which is at least 1 to 75% in excess over the amount of metal required to deposit a predetermined thickness of said malleable metal uniformly over said metal articles and agitating the resulting mixture of solids and plating liquid in the tumbling zone for a time empirically predetermined to provide a malleable metal plating of predetermined thickness on said metal articles while the plating liquid becomes depleted;

h. removing the depleted plating liquid including metal powder suspended therein from the tumbling zone and passing it to a plating liquid storage zone;

i. adding rinse water to the plated metal articles and impacting media in the tumbling zone and agitating the mixture to effect rinsing of the plated metal articles;

j. removing the used rinse water from the tumbling zone and passing it to a rinse water storage zone;

k. removing the plated metal articles and the impacting media from the tumbling zone and separating the articles from the media;

l. storing the separated media in a media storage zone;

m. recovering the plated metal articles; and wherein

B. another cycle comprising steps (a) through (m) is started upon loading a new batch of base metal articles to the tumbling zone in step (a), returning to said tumbling zone in step (a) of the last mentioned cycle the spent acid solution from the spent acid storage zone and adding a make-up amount of cleaning acid thereto to insure proper acidity for cleaning the metal articles; also returning to the tumbling zone in step (a) the media from the media storage zone; returning to said tumbling zone in step (d) the spent copper solution from the spent copper solution storage zone and adding a make-up amount of copper solution thereto; returning to the tumbling zone in step (f) the spent plating liquid and metal powder from the plating liquid storage zone and adding make-up amounts of promoter chemicals and malleable metal powder thereto; and returning to the tumbling zone in step (i) the previously used rinse water from the rinse water storage zone and adding a make-up amount of rinse water thereto;

and wherein

C. additional cycles comprising steps (a) through (m) are repeated a number of times until process performance drops to a predetermined minimum, at which stage the plating liquid containing suspended and dissolved metal compounds is rectified by adding alkali thereto, the resulting precipitate is mechanically separated from the rectified liquid and the rectified liquid is used in another cycle of the process after acidifying it to a pH of not more than 6.

9. A process according to claim 8 wherein the plating metal is zinc and wherein substantially all of the copper added as a copper salt in one cycle of the process is plated out as metallic copper on the articles in the same cycle and only an inconsequential amount of copper remains in solution at the end of step (c).

10. A process according to claim 8 wherein substantially all of the tin added as a tin salt in one cycle of the process is plated out as metallic tin on the articles in the same cycle and only an inconseqential amount of tin remains in solution at the end of step (e).

11. A process according to claim 10 wherein the sequence of steps (a) through (m) is repeated at least four times until process performance drops to a predetermined minimum limit, at which stage the plating liquid is rectified by reducing the metal content thereof to less than 20,000 ppm by precipitation with alkali and mechanical separation of the resulting precipitate therefrom, and the rectified liquid is used in another sequence of steps (a) through (m).

12. A process according to claim 8 wherein the base metal articles are ferrous articles and wherein the plating metal is zine and the plating liquid comprises a sequestering agent and wherein the sequence of steps (a) through (m) is repeated a number of times until plating efficiency determined as the ratio of the actual plating thickness on the recovered plated metal over the targeted plating thickness is reduced to below 100% and not less than 90% at which stages the plating liquid is rectified by reducing the metal content thereof to less than 20,000 ppm by precipitation with alkali and mechanical separation of the resulting precipitate therefrom, and the rectified liquid is used in another sequence of steps (a) through (m).

13. A process according to claim 8 wherein the ferrous metal articles to be plated have a bulk density between 80 and 240 kg/m$^3$ and wherein the plating metal powder is present in step (g) in an amount which is at least 50% in excess over the amount of metal required to deposit a predetermined thickness of plating metal on the ferrous metal articles.

14. A process according to claim 12 wherein the ferrous metal articles to be plated have a bulk density between about 80 and 240 kg/m$^3$ and wherein the plating metal powder is present in step (g) in an amount sufficient to provide a concentration of plating metal powder in the mixture of at least 2.6 grams per liter.

* * * * *

UNITED STATES PATENT AND TRADEMARK OFFICE

CERTIFICATE OF CORRECTION

PATENT NO. : 4,062,990

DATED : December 13, 1977

INVENTOR(S) : Lester Coch

It is certified that error appears in the above-identified patent and that said Letters Patent are hereby corrected as shown below:

In the heading at [73], correct the spelling of "Waldes".

Column 18, line 62, after "thereto" insert to.

Column 19, line 51, correct the spelling of "ecologically".

Column 22, line 7, change "stages" to read stage.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*